United States Patent [19]

Cummins

[11] Patent Number: 4,621,810

[45] Date of Patent: Nov. 11, 1986

[54] WEIGHT LIFTING TYPE EXERCISING DEVICE

[76] Inventor: Joseph B. Cummins, 606 McAdoo, Clinton, Tenn. 37716

[21] Appl. No.: 728,310

[22] Filed: Apr. 29, 1985

[51] Int. Cl.[4] ..... A63B 21/00

[52] U.S. Cl. ..... 272/134; 272/117; 272/123

[58] Field of Search ..... 272/117, 123, 122, 134, 272/93, 116, 118, 120, 136, 143

[56] References Cited

U.S. PATENT DOCUMENTS

| | | | |
|---|---|---|---|
| 458,382 | 8/1891 | Zander | 272/117 |
| 684,688 | 10/1901 | Herz | 272/117 |
| 4,211,403 | 7/1980 | Coffaro et al. | 272/134 |
| 4,226,414 | 10/1980 | Coffaro et al. | 272/117 |
| 4,266,766 | 5/1981 | Calderone | 272/117 |
| 4,405,128 | 9/1983 | McLaughlin et al. | 272/134 X |

FOREIGN PATENT DOCUMENTS

| | | | |
|---|---|---|---|
| 2314638 | 10/1974 | Fed. Rep. of Germany | 272/134 |

*Primary Examiner*—Richard J. Apley
*Assistant Examiner*—Robert W. Bahr
*Attorney, Agent, or Firm*—Pitts and Brittian

[57] ABSTRACT

An exercise device (10) for safely performing weight lifting exercises. The device (10) includes a frame (16) defining a base portion and provided with a vertically oriented back support member (32) for supporting the back of the operator. A lever assembly (12) is pivotally mounted proximate the forward end portion of the frame (16) for being selectively pivoted by the operator during exercise. Secured to the lever assembly (12) and extending rearwardly therefrom is a weight support assembly (13) provided at its outboard end portion with a weight carrying bar for receiving weight members. In one preferred embodiment the device (10) is also provided with a weight catch assembly (14) pivotally secured to the rear portion of the frame (16) for selectively supporting the weight carrying bar in an at rest position.

14 Claims, 5 Drawing Figures

WEIGHT LIFTING TYPE EXERCISING DEVICE

DESCRIPTION

1. Technical Field

This invention relates to an exercise device for performing weight lifting exercises. The exercise device of the present invention generally comprises a lever assembly and a weight catch assembly pivotally mounted on a frame, the lever assembly carrying a weight support assembly which pivots therewith.

2. Background Art

The exercise commonly known as the "bench press" has long been a popular weight lifting exercise for strengthening the arms and upper body. In the past this exercise has been performed using a conventional weight bench and conventional barbells. In performing this exercise, the weight lifter lies on his back and presses the barbells from a position proximate his chest upwardly until his arms are extended, and then returns the barbells to the starting position. Of course, the hazards of lifting large amounts of weight over one's body are obvious, and these hazards have long been recognized by weight lifters. Accordingly, it has been a common practice for an assistant or "spotter" to be present when the bench press and similar pressing exercises are performed to catch the barbells or otherwise assist the lifter should he lose control of the weights or need other assistance. However, even with a spotter the bench press remains a hazardous exercise where conventional weight lifting equipment is used.

Certain attempts have been made to devise exercise devices on which pressing exercises can be performed at less risk to the lifter, but these devices have tended to be complex pieces of machinery which are expensive and inconvenient to use. Examples of two such devices are disclosed in U.S. Pat. No. 4,406,452, issued to P. S. Lapcevic, and U.S. Pat. No. 2,932,509, issued to H. Zinkin.

Therefore, it is an object of the present invention to provide an exercise device which allows pressing exercises to be performed safely.

It is another object of the present invention to provide an exercise device which allows pressing exercises to be performed from a standing position.

Still another object of the present invention is to provide an exercise device which allows pressing exercises to be performed without the aid of an assistant or spotter.

A further object of the present invention is to provide an exercise device which is inexpensive to manufacture and maintain.

DISCLOSURE OF THE INVENTION

Other objects and advantages will be accomplished by the present invention which provides an exercise device for safely performing weight lifting exercises. The device comprises a frame defining a base portion and provided with a vertically oriented back support member for supporting the back of the operator. A lever assembly is pivotally mounted proximate the forward end portion of the frame for being selectively pivoted by the operator during exercise. Secured to the lever assembly and extending rearwardly therefrom is a weight support assembly provided at its outboard end portion with a weight carrying means for receiving weight members. Given the fixed relationship between the upwardly extending lever assembly and the rearwardly extending weight support assembly, gravity acting upon the weight members produces resistance to the forward pivoting of the lever assembly. Accordingly, exercise is accomplished through the selective pivoting of the lever assembly as the operator stands supported against the back support member of the frame. In the preferred embodiment, the device is also provided with a weight catch assembly pivotally secured to the rear portion of the frame for selectively supporting the weight carrying means in an at rest position.

BRIEF DESCRIPTION OF THE DRAWINGS

The above mentioned features of the present invention will become more clearly understood from the following detailed description of the invention read together with the drawings in which.

BEST MODE FOR CARRYING OUT THE INVENTION

Figure 1:
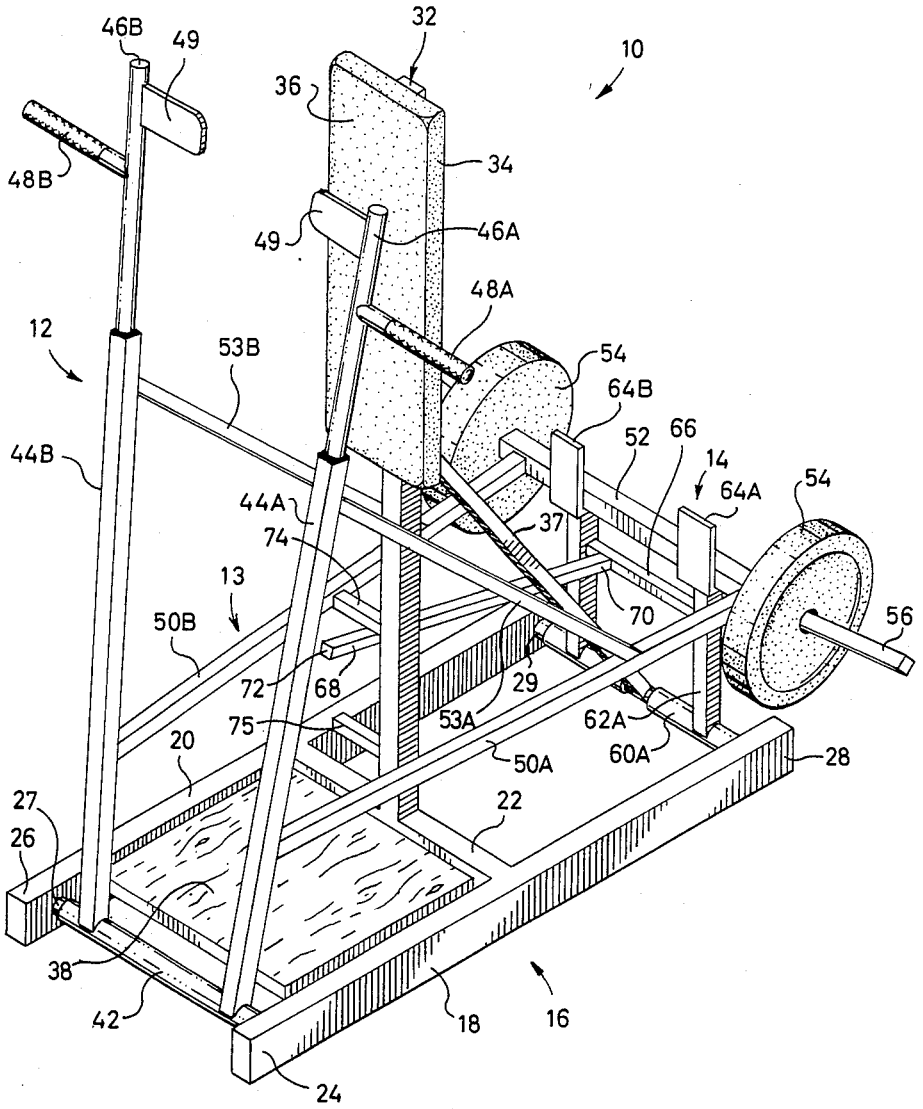
FIG. 1 illustrates a perspective view of the exercise device of the present invention.

An exercise device incorporating various features of the present invention is illustrated generally at 10 in the figures. As will be discussed in detail below, the present invention provides an exercise device which allows the weight lifting exercise commonly known as the "bench press", as well as various related pressing exercises, to be performed safely and from a standing position. It will also be noted that whereas the preferred embodiment of the device utilizes conventional weight disks or "plates", when performing exercises on the device 10, the operator is removed from the proximity of the plates obviating much of the hazard generally associated with performing pressing exercises on a conventional weight bench with conventional barbell equipment.

Generally the exercise device 10 comprises a lever assembly 12 and a weight catch assembly 14 both pivotally mounted on a frame 16, with the lever assembly 12 carrying a rearwardly extending weight support assembly 13. More specifically, the frame 16 defines a base portion comprising a pair of oppositely disposed side supports 18 and 20 joined by a center support 22. As illustrated, the side supports 18 and 20 and the center support 22 define an H-shape base which lends stability to the device 10. Each of the side supports 18 and 20 define forward end portions 24 and 26, respectively, and rearward end portions 28 and 30, respectively. Further, the frame 16 is provided with a forward pivot shaft 27 on which the lever assembly 12 is pivotally mounted and a rear pivot shaft 29 on which the catch assembly 14 is pivotally mounted. It will be understood that whereas the illustrated shafts 27 and 29 are a preferred means of pivotally mounting the lever assembly 12 and the catch assembly 14, other suitable means for pivotally mounting the assemblies 12 and 14 can be used.

The frame 16 further comprises a back support member 32 which is mounted at its lower end portion to the center support 22 and carries a forwardly facing back support panel 34 proximate the upper end portion of the support member 32. In the preferred embodiment of the device 10, the back support panel is provided with a cushioned surface 36 which engages the operator's back during exercise. It will be appreciated that whereas the cushioned surface 36 is not a required feature of the device 10, the surface 36 serves to cushion the contact between the operator's back and the back support panel 34, thereby making exercise more comfortable and decreasing the risk of injury to the operator's back.

Another optional feature of the preferred illustrated embodiment is the platform 38 which is supported by and secured to a pair of brace members 40 (only one shown), the brace members 40 being secured at their opposite ends to the side supports 18 and 20. Whereas the device 10 can be operated with the operator standing on the floor or other supporting surface, independent of the device, under such circumstances the operator must be concerned with maintaining the relative position of the device and inadvertent movement of the device can disrupt exercise. Therefore, the platform 38 allows the operator to stand on the base portion of the frame 16 so as to fix the relative positions of the device 10 and the operator and further stabilize the frame as a result of the addition of the operator's weight. It should also be noted that in the preferred embodiment the frame 16 is also provided with a brace 37 extending between the rear pivot shaft 29 and the back support member 32 to further strengthen and stabilize the frame 16.

Figure 2:
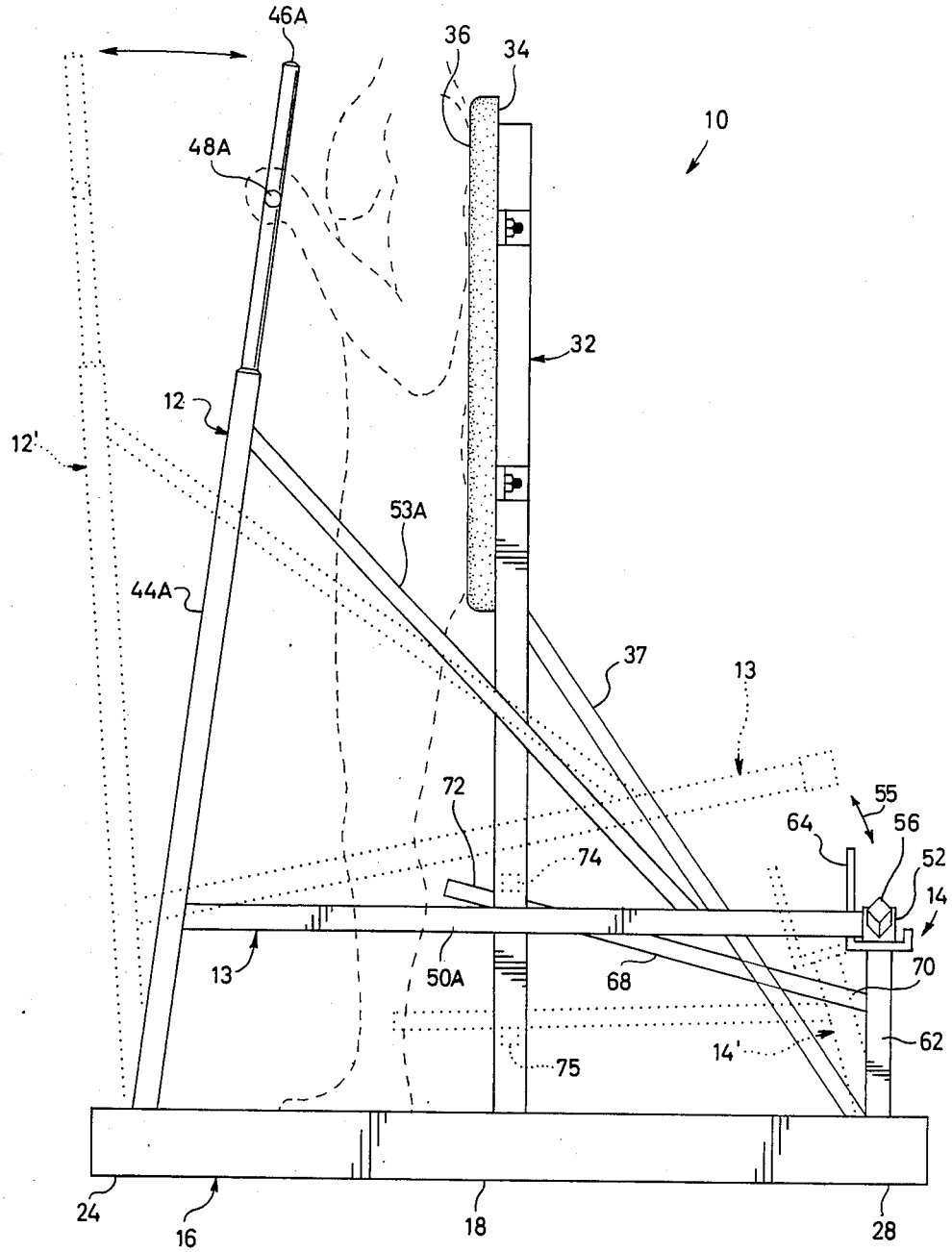
FIG. 2 illustrates a side elevation view of the exercise device of the present invention.
Figure 3:
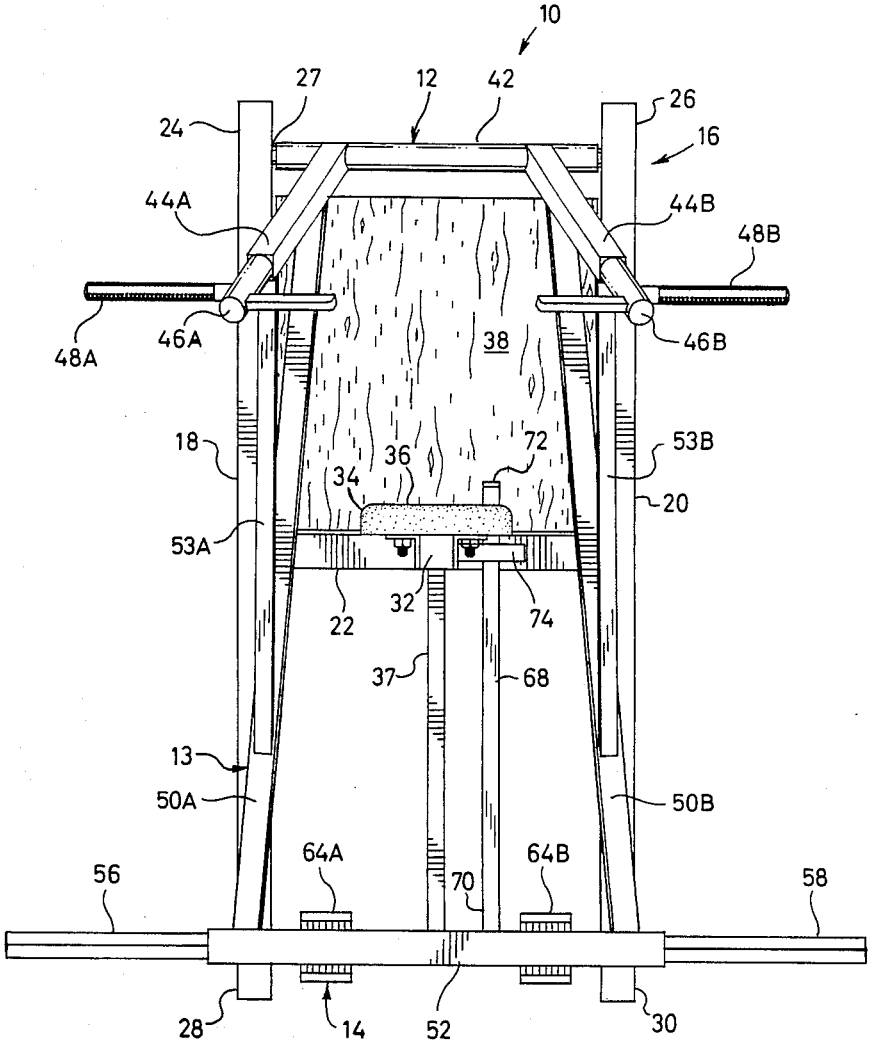
FIG. 3 illustrates a top view of the exercise device of the present invention.

As indicated above the lever assembly 12 is pivotally mounted on the forward pivot shaft 27 of the frame 16, and to facilitate such pivotal mounting the lever assembly 12 comprises a sleeve member 42 which is rotatably received around the shaft 27. The lever assembly further comprises a pair of lever arms 44A and 44B which are secured to the sleeve member 42 at their lower end portions and extend outwardly therefrom, terminating in the outboard end portions 46A and 46B. Proximate the outboard end portions 46A and 46B, the lever arms 44A and 44B carry handle members 48A and 48B, respectively. As is illustrated the handle members 48A and 48B are oriented such that they extend outwardly from the lever arms 44A and 44B so as to be aligned roughly parallel to the axis of the shaft 27. Accordingly, as illustrated in FIG. 2, the operator can grasp the handle members 48 and selectively pivot the lever arms 44. It will be noted that in the preferred embodiment illustrated, the handle members 48 are provided with knurled exterior surfaces to facilitate a slip-free grip.

In the preferred embodiment of the device 10, the lever arms 44A and 44B are also provided with inwardly disposed press plates 49. The press plates 49 are employed in the performance of an alternative pressing exercise wherein the operator presses on the press plates 49 instead of the handle members 48, thereby placing different muscles under stress during exercise.

The weight support assembly 13 comprises a pair of weight bar support arms 50A and 50B which are secured at their forward ends to, and extend rearwardly from, the lever arms 44A and 44B, respectively, with the outboard end portions of the support arms 50A and 50B being secured to, and supportive of, weight carrying means which in the preferred embodiment comprises a weight bar 52. Further, in order to strengthen the device 10, the braces 53A and 53B are secured at their opposite ends to the lever arms 44 and the support arms 50. Accordingly, given the fixed, roughly perpendicular, relationship between the lever arms 44 and the support arms 50, the forward pivoting of the lever arms 44 translates into the pivoting of the weight bar 52 in generally an upward direction as illustrated by arrow 55 in FIG. 2.

In the preferred illustrated embodiment of the device 10, conventional weight disks or plates 54 are releasably received and supported by the opposite end portions 56 and 58 of the weight bar 52 as illustrated in FIG. 1. Accordingly, it will be appreciated by those skilled in the art that when weights 54 are mounted on the weight bar 52, gravity acting upon such weights translates into a corresponding resistance to the forward pivoting of the lever arms 44A and 44B. Thus, exercise is accomplished by the operator exerting sufficient outward force on the handle members 48A and 48B, or the press plates 49, of the lever arms 44A and 44B to overcome the gravitational force acting upon the weights 54, thereby pivoting the lever arms 44 forward, followed by the controlled reciprocation of handle members 48 to a position proximate the operator's chest. Therefore, it will be understood that the exercise device 10 allows an exercise comparable to the conventional "bench press" to be performed without the operator having to precariously balance a barbell over his or her body. In fact, as noted above, the weights 54 mounted on the weight bar 52 are removed from the proximity of the operator. Further, the horizontal alignment of the bar 52 is fixed such that exercise is not disrupted by constant manual adjustments to the bar in an attempt to keep the weights balanced as is the case when a conventional bench press is performed on a weight bench.

Figure 5:
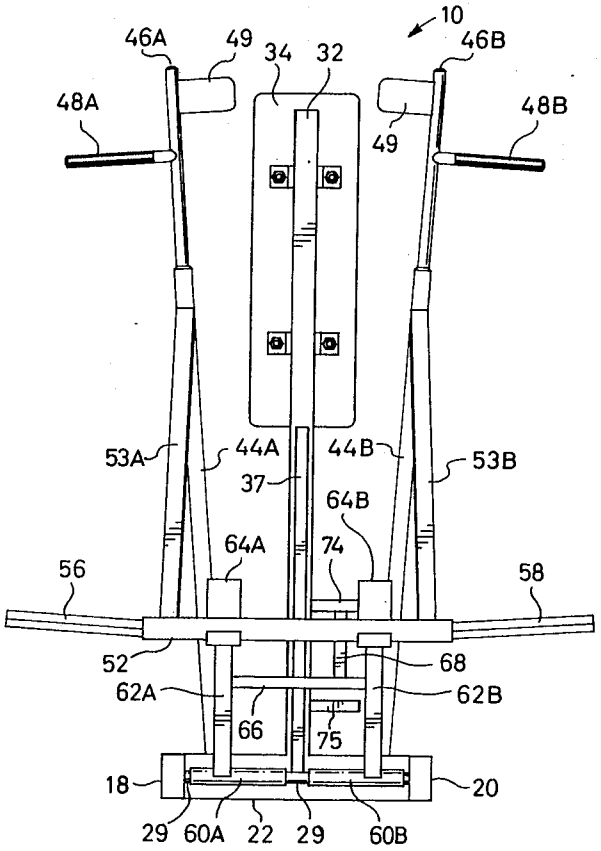
FIG. 5 illustrates a rear elevation view of the exercise device of the present invention.
Figure 4:
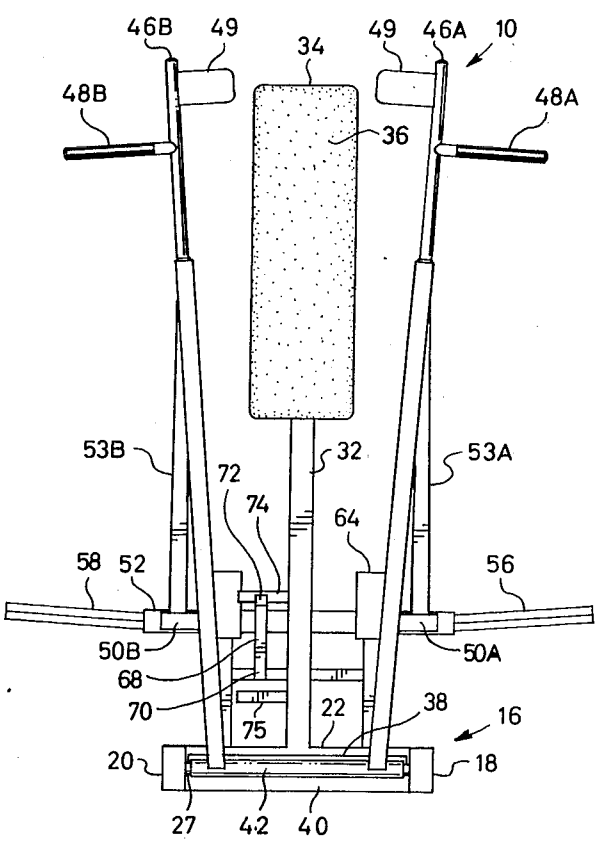
FIG. 4 illustrates a front elevation view of the exercise device of the present invention.

As is best illustrated in FIGS. 4 and 5, in the preferred embodiment of the device 10 the opposite end portions 56 and 58 of the weight bar 52 tilt upwardly at a slight angle. Accordingly, when weights 54 are placed on the end portions 56 and 58 this upward tilt insures that the weights will not slide off of the end portions, thus obviating the need for clamping devices to maintain the position of the weights and facilitating the ease with which weights can be added to or removed from the bar 52. Of course, it will be appreciated that the illustrated weight bar is simply one preferred weight carrying means and other weight carrying means can be secured to the support arms 50A and 50B or a weight member can be fixedly secured to the support arms 50A and 50B if desired.

In order to further insure safe performance of exercise using the exercise device 10, the catch assembly 14 is provided for selectively supporting the weight bar 52 in a preselected pivotal position whereby the lever arms 44A and 44B are held at a safe distance from the chest of the operator. (See FIG. 2) The catch assembly 14 comprises a pair of sleeve members 60A and 60B which are rotatably received on the rear pivot shaft 29 of the frame 16. A pair of support arms 62A and 62B are secured at their lower ends to, and extend outwardly from, the sleeve members 60A and 60B, respectively, and carry on their outboard ends a pair of saddle members 64A and 64B, respectively. Of course, as illustrated, the saddle members 64 serve to selectively receive and support the weight bar 52. In order to facilitate the common pivotal alignment of the support arms 62 and their operatively associated saddle members 64, a horizontal brace member 66 is provided, the brace member 66 being secured at a first end to the support arm 62A and secured at a second end to the support arm 62B. In order to allow the operator to adjust the pivotal position of the saddle members 64, a manipulator rod 68 is provided. The rod 68 is secured at its rearward end 70 to the brace member 66, with the forward end 72 of the rod 68 extending in a forward direction just beyond the back support member 32 of the frame 16. The forwardly disposed positioning of the rod 68 is maintained, and its pivoting range defined, by the stop members 74 and 75 which are secured to and extend outwardly from the back support member 32 of the frame 16. As illustrated, the range of pivot defined by the stop members 74 and 75 maintain the forward end portion 72 of the rod 68 within reach of the operator's right foot at all times. Accordingly, when the operator desires to pivot the catch assembly 14 forward such that the weight bar is unsupported and ready for exercise, the operator simply pivots the lever arms 44 forward removing the bar 52 from the saddle members 64 and kicks the manipulator rod 68 in a downward direction. In this regard, once the catch assembly is pivoted forwardly and is no longer vertically oriented, gravity biases the catch assembly to the disengaged position illustrated by the broken lines 14' of FIG. 2. When the operator begins to tire and wishes to engage the catch assembly 14, the operator's foot is once again used to move the rod 68, this time manipulating the rod 68 in an upward direction until it engages the stop member 74. Thereupon the lever arms 44 can be allowed to move rearwardly, lowering the weight bar 52 into the saddle members 64.

From the above discussion it will be appreciated that the exercise device of the present invention allows pressing exercises to be performed without the hazards normally associated with performing such exercises on a conventional weight bench and otherwise reduces the risk of injury to the operator during exercise. Further, the catch assembly obviates the need for a spotter to assist the operator with the weights, freeing the operator to exercise without assistance. Accordingly, the exercise device of the present invention provides a safe and efficient means for performing pressing exercises, and offers many advantages over the prior art.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An exercise device for use by an operator in performing weight lifting exercises, said device being utilized in conjunction with at least one weight member, said device comprising:

a frame defining a forward end and a rearward end, said frame comprising a base portion and a substantially vertically oriented back support member mounted on said base portion of said frame intermediate said forward end and said rearward end for supporting the back of said operator during said exercise;

a lever assembly pivotally mounted on said frame proximate said forward end for movement by said operator during said exercise, said lever assembly comprising first and second cooperating lever arms each having a first end pivotally connected to said frame and a second end, each said lever arm being provided with at least one handle member for grasp by said operator to effect said movement of said lever assembly; and a weight support assembly rigidly secured to and extending rearwardly from said lever assembly to proximate said rearward end of said frame, said support weight assembly comprising a pair of arms each having a first end attached to a corresponding one of said lever arms, and second ends defining an outboard end portion for said weight support assembly, said outboard end portion provided with a weight bar for receiving said at least one weight member, said weight bar provided with opposite end portions extending from said weight support assembly for receiving said at least one weight member whereby gravity acting upon said weight member produces resistance to the selective pivoting of said lever assembly by said operator during said exercise.

2. The exercise device of claim 1 wherein said forward end portion of said frame is provided with a forward pivot shaft, and wherein each said first ends of said lever arms are attached to a first sleeve member, said first sleeve member being rotatably received around said forward pivot shaft of said frame.

3. The exercise device of claim 1 wherein said device further comprises a weight catch assembly pivotally secured to said frame for selectively supporting said weight bar of said weight support assembly whereby said lever assembly is selectively held in a preselected position.

4. The exercise device of claim 3 wherein said catch assembly comprises at least one support arm provided at a lower end portion with means for pivotally securing said catch assembly to said frame and provided at an upper end portion with a saddle member for engaging said weight bar, said catch assembly further comprising manipulator means whereby said catch assembly can be selectively pivoted in and out of contact with said weight bar.

5. The exercise device of claim 4 wherein said rearward end portion of said frame is provided with a transverse rear pivot shaft, and wherein said means for pivotally securing said catch assembly to said frame comprises a second sleeve member secured to said lower end portion of said at least one support arm of said catch assembly, said second sleeve member being rotatably received around said rear pivot shaft of said frame.

6. The exercise device of claim 5 wherein said catch assembly comprises a pair of said support arms cooperatively joined by a brace member, and wherein said manipulator means comprises a manipulator rod having a first and second end portion, said first end portion being secured to said brace member, said manipulator rod extending forwardly from said brace member whereby said outboard end portion of said manipulator rod is oriented proximate said back support member to facilitate the pivoting of said rod by said operator.

7. The execise device of claim 1 wherein said frame comprises first and second side supports and a center support, said center support having first and second end portions, said first end portion of said center support being secured to said first side support and said second end portion of said center support being secured to said second side support, and wherein said back support member defines a lower end portion secured to said center support.

8. The exercise device of claim 1 wherein said back support member further comprises a back support panel provided with a cushioned surface for engaging the back of said operator.

9. The exercise device of claim 6 wherein said frame further comprises a pair of stop members mounted on said back support for limiting pivotal travel of said manipulator rod of said catch assembly.

10. The exercise device of claim 1 wherein said frame is provided with a platform for supporting said operator during exercise.

11. The exercise device of claim 1 wherein each said lever arm is further provided with a press plate to be used by said operator for selectively pivoting said lever assembly during said exercise.

12. The exercise device of claim 1 wherein said opposite end portions of said weight bar are upwardly tilted at a preselected angle for supporting said at least one weight member in place on said weight bar.

13. An exercise device for use by an operator in performing weight lifting exercises, said device being utilized in conjunction with at least one weight member, said device comprising:

a frame comprising a base portion and a substantially vertically oriented back support member mounted on said base portion of said frame for supporting the back of said operator during exercise, said frame defining a forward end portion provided with a forward pivot shaft and a rear end portion provided with a rear pivot shaft;

a lever assembly pivotally mounted on said frame forward of said back support member, said lever assembly comprising first and second cooperatively pivoting lever arms, each said first and second lever arm defining a lower end portion, said lever assembly further comprising a first sleeve member secured to said first and second lever arms proximate said lower end portions, said sleeve member being rotatably received around said forward pivot shaft of said frame, each said first and second lever arm further comprising a handle member for selectively pivoting said lever assembly;

a weight support assembly secured to and extending rearwardly from said lever assembly, said weight support assembly comprising first and second support arms, each said support arm having a forward end portion and a rearwardly disposed outboard end portion, said forward end portion of said first support arm being secured to said first lever arm and said forward end portion of said second support arm being secured to said second lever arm, said weight support assembly further comprising a weight bar secured to said outboard end portions of said first and second support arms of said weight support assembly; and a weight catch assembly pivotally secured to said frame for selectively supporting said weight bar at a preselected position, said catch assembly comprising first and second support arms, each said support arm defining upper and lower end portions, said upper end portions being provided with saddle members for selectively engaging and supporting said weight bar and said lower end portions being provided with second sleeve members for being rotatably received around said rear pivot shaft of said frame, said support arms of said catch assembly being joined by a brace member in substantially parallel alignment, said catch assembly further comprising manipulator means for selectively pivoting said catch assembly.

14. An exercise device for use by an operator in performing weight lifting exercises while in a standing position, said device being utilized in conjunction with at least one weight member, said device comprising:

a frame defining a forward end and a rearward end, said frame comprising a base portion and a substantially vertically oriented back support member mounted on said base portion of said frame intermediate said forward end and said rearward end for supporting the back of said operator during said exercise, said frame being provided with a transverse forward pivot shaft at said forward end;

a lever assembly pivotally mounted on said frame for movement by said operator during said exercise, said lever assembly comprising first and second cooperating lever arms each attached to a sleeve member rotatably received around said forward pivot shaft, each said lever arm being provided with at least one handle member for grasp by said operator to effect said movement of said lever assembly; and a weight support assembly rigidly secured to and extending rearwardly from said lever assembly to proximate said rearward end of said frame, said weight support assembly comprising a pair of arms each having a first end attached to a corresponding one of said lever arms, and second ends defining an outboard end portion for said weight support assembly, said outboard end portion provided with a weight bar for receiving said at least one weight member, said weight bar provided with opposite end portions extending from said weight support assembly for receiving said at least one weight member whereby gravity acting upon said weight member produces resistance to the selective pivoting of said lever assembly by said operator during said exercise.

* * * * *